US007115158B1

(12) United States Patent
Landrum

(10) Patent No.: US 7,115,158 B1
(45) Date of Patent: Oct. 3, 2006

(54) FAN HAVING BLADE MEMBERS THAT HEAT AND COOL AND HAS AN IONIZING GRID FOR AIR PURIFICATION

(76) Inventor: Stephen Ray Landrum, 1406 Portland, Plainview, TX (US) 79072

( * ) Notice: Subject to any disclaimer, the term of this patent is extended or adjusted under 35 U.S.C. 154(b) by 171 days.

(21) Appl. No.: 10/876,221

(22) Filed: Jun. 24, 2004

Related U.S. Application Data

(60) Provisional application No. 60/482,531, filed on Jun. 25, 2003.

(51) Int. Cl.
*B03C 3/36* (2006.01)

(52) U.S. Cl. ..... 96/19; 55/467.1; 55/471; 96/63; 416/95; 416/96 A

(58) Field of Classification Search ..... 55/467.1, 55/467, 471; 96/19, 60–63; 416/95, 96 A, 416/146 R; 95/4, 67, 73, 78
See application file for complete search history.

(56) References Cited

U.S. PATENT DOCUMENTS 3,422,263 A * 1/1969 Asahina ..... 361/231
4,422,824 A * 12/1983 Eisenhardt, Jr. ..... 416/5
4,504,191 A * 3/1985 Brown ..... 416/5
4,596,585 A * 6/1986 Moeller et al. ..... 95/57
4,782,213 A * 11/1988 Teal ..... 392/362
5,545,009 A * 8/1996 Ke ..... 416/5
5,624,230 A * 4/1997 Taylor et al. ..... 416/5
5,795,131 A * 8/1998 Crowhurst et al. ..... 416/146 R
6,779,976 B1 * 8/2004 Carfagna et al. ..... 416/5
6,790,004 B1 * 9/2004 Steinheiser ..... 416/65
2002/0192075 A1 * 12/2002 Block ..... 415/176
2003/0206801 A1 * 11/2003 Lee ..... 416/31

FOREIGN PATENT DOCUMENTS

JP 5-99191 * 4/1993 ..... 416/146 R

* cited by examiner

*Primary Examiner*—Richard L. Chiesa
(74) *Attorney, Agent, or Firm*—Michael I Kroll

(57) ABSTRACT

A ceiling fan that incorporates into its blades both a system for air purification by removing dust and other particulate pollutants from the air in a room through ionization of the air stream passing over an ionizer grid and also a system for heating and cooling the air stream passing over the blades. The device provides a room conditioner for efficiently heating or cooling and maintaining a room at a temperature comfortable to the user. The device also provides negative ion generation through the use of the ionizer.

8 Claims, 8 Drawing Sheets

FAN HAVING BLADE MEMBERS THAT HEAT AND COOL AND HAS AN IONIZING GRID FOR AIR PURIFICATION

RELATED APPLICATIONS

This application is subject to U.S. provisional application Ser. No. 60/482,531, filed 25 Jun. 2003. Please incorporate by reference all information in said provisional application into this instant application.

BACKGROUND OF THE INVENTION

1. Field of the Invention

The present invention relates generally to fans and, more specifically, to a ceiling fan that incorporates into its blades both a system for air purification through ionization of the air stream passing over the ionizer grid and also a system for heating and cooling the air stream passing over the blades. The device provides a room conditioner for efficiently heating or cooling and maintaining a room at a temperature comfortable to the user. The device also removes dust and other particulate pollutants from the air in a room.

2. Description of the Prior Art

There are other devices designed for removing particulate matter from the air by means of ionization. There are no known fans having blades comprising spaced apart members having a space therein providing means applying a voltage and thereby ionizing the air stream.

Therefore, while these other devices may be suitable for the purposes for which they were designed, they would not be as suitable for the purposes of the present invention, as hereinafter described.

SUMMARY OF THE PRESENT INVENTION

A primary object of the present invention is to provide a fan having means for removing particulate matter from the ambient air.

Another object of the present invention is to provide a fan having a blade that will heat and cool air passing over the radiative fins Still yet another object of the present invention is to provide a fan having blades having means for changing the pitch of the blades.

Additional objects of the present invention will appear as the description proceeds.

The present invention overcomes the shortcomings of the prior art by providing a ceiling fan that incorporates into its blades both a system for air purification through ionization of the air stream passing over the ionizer grid and also a system for heating and cooling the air stream passing over the blades. The device provides a room conditioner for efficiently heating or cooling and maintaining a room at a temperature comfortable to the user. The device also removes dust and other particulate pollutants from the air in a room.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
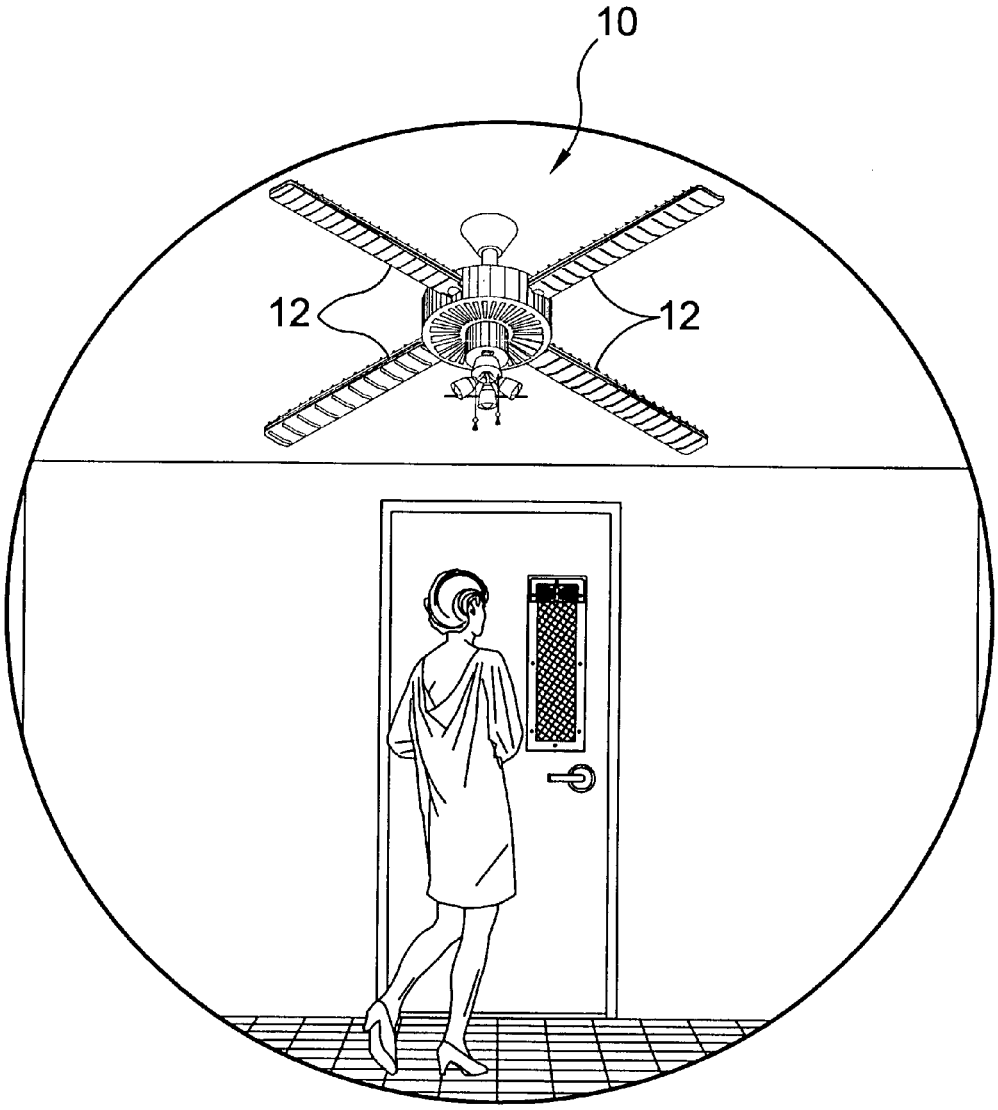
FIG. 1 is an illustrative view of the present invention in use.

Turning now descriptively to the drawings, in which similar reference characters denote similar elements throughout the several views, the figures illustrate the Fan Having Blade Members that Heat and Cool and has an Ionizing Grid for Air Purification of the present invention. With regard to the reference numerals used, the following numbering is used throughout the various drawing figures.

10 Ceiling Fan Having Blade Members that Heat and Cool and has an Ionizing Grid for Air Purification
12 fan blade
13 leading edge of 12
14 blade upper half
16 blade lower half
17 radiative fins
18 ionization grid
20 upper positive wire grid
22 negative wire grid
24 lower positive wire grid
26 upper thermoelectric plate
27 lower thermoelectric plate
30 aluminum substrate heat sink
31 temperature sensor
32 control module
33 thermoelectric sandwich
34 insulated screw

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. The present invention 10 is a ceiling fan which incorporates into its fan blades 12 both a system for air purification through ionization of the air stream passing over the ionizer grid and also a system for heating and cooling the air stream passing over the blades. The device provides a room conditioner for efficiently heating or cooling and maintaining a room at a temperature comfortable to the user. The device also removes dust and other particulate pollutants from the air in a room.

Figure 2:
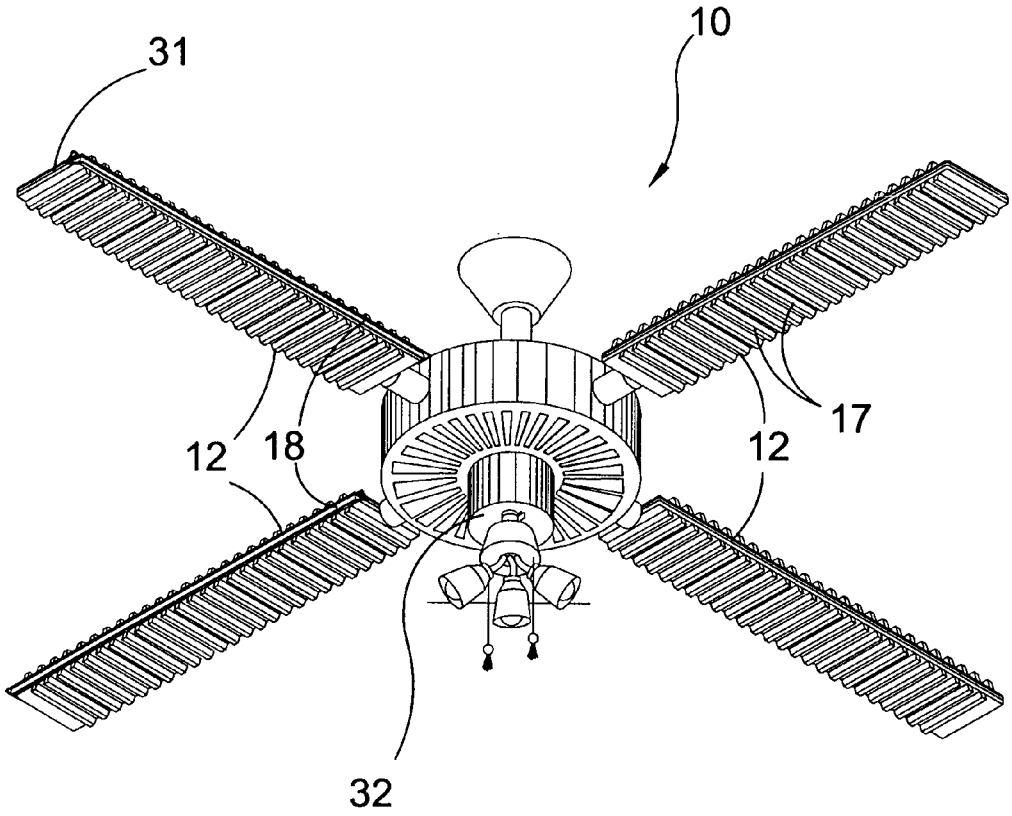
FIG. 2 is a perspective view of the present invention.

FIG. 2 is a perspective view of the present invention 10. Shown is a perspective view of the present invention 10, a ceiling fan which incorporates into its blades 12 both a system for air purification through ionization of the air stream passing over the cleaning grid, also a system for heating and cooling the air stream passing over the blades. The device provides a room conditioner for efficiently heating or cooling and maintaining a room at a temperature comfortable to the user by using a temperature sensor 31 to inform the control module 32 of the temperature of the ambient air to determine whether the radiative fins 17 need to heat or cool the air to achieve the temperature selected by the user. The ionization grid 18 serves to remove dust and other particulate pollutants from the air in a room.

Figure 3:
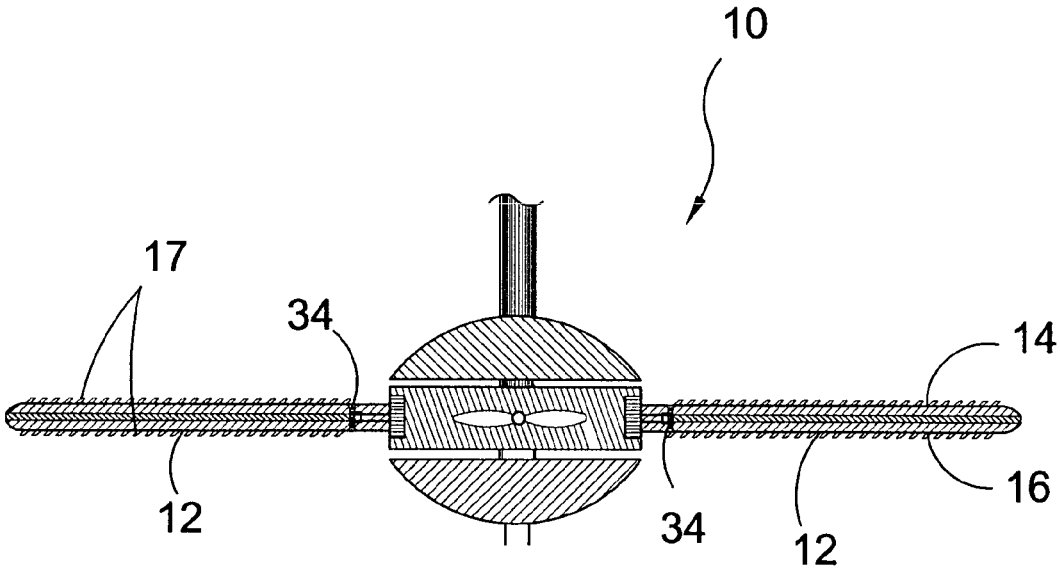
FIG. 3 is a sectional view of the present invention.

FIG. 3 is a sectional view of the present invention 10. Shown is a sectional view of the present invention 10, a ceiling fan having blades 12 which will rotate 30 degrees up or 30 degrees down to regulate air flow as well as help to control the radiating fins 17 associated with the heating and cooling system. Each blade 12 is divided into an upper blade half 14 and a lower blade half 16 with radiative fins 17 extending angularly therefrom with insulated screws 34 holding the blade 12 components together.

Figure 4:
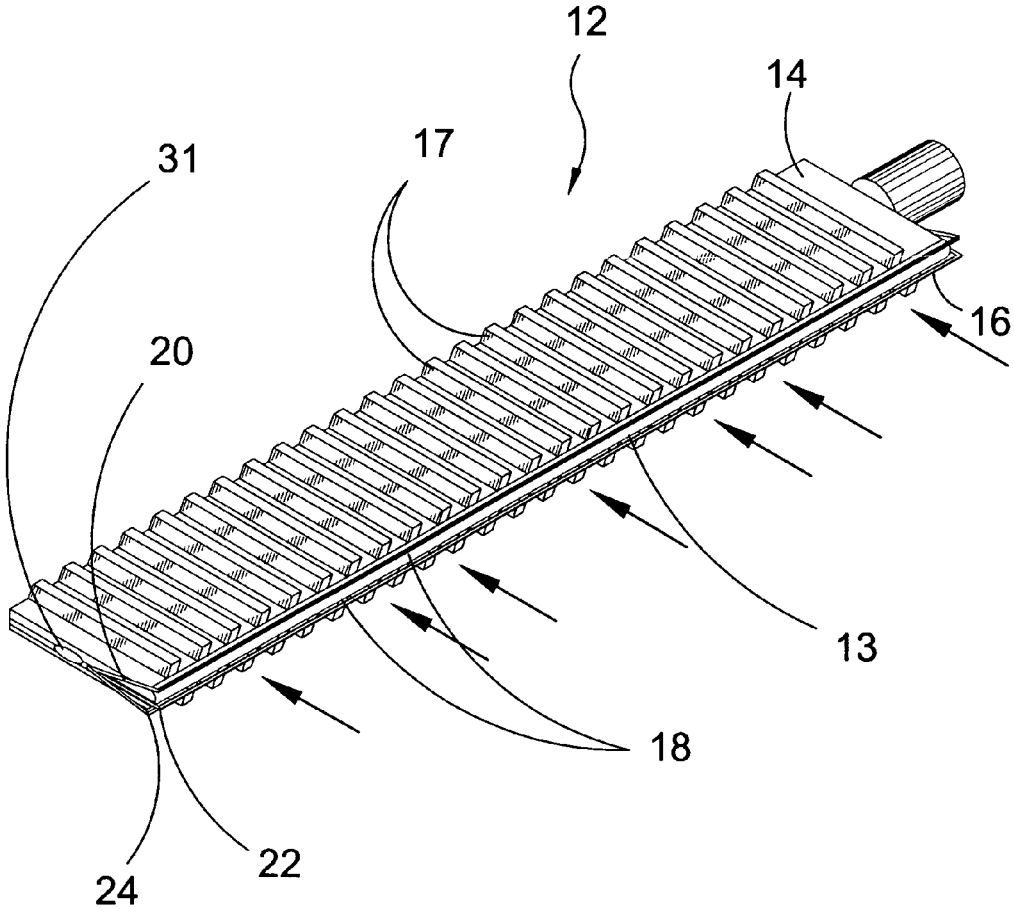
FIG. 4 is a partial detailed view of the present invention.

FIG. 4 is a partial detailed view of the present invention 10. Shown is a detailed view of a fan blade 12 with a temperature sensor 31 incorporated therein providing means for sensing and responding to temperature variations. The ionization grid 18 refers to the gaps between the negative 22, upper positive 20 and lower positive 24 grid wires and are integral with the upper 14 and lower 16 blade structure. When in operation air passes through the gap and is cleansed, it then passes through a plurality of radiative fins used to either cool or warm the air for the user.

Figure 5:
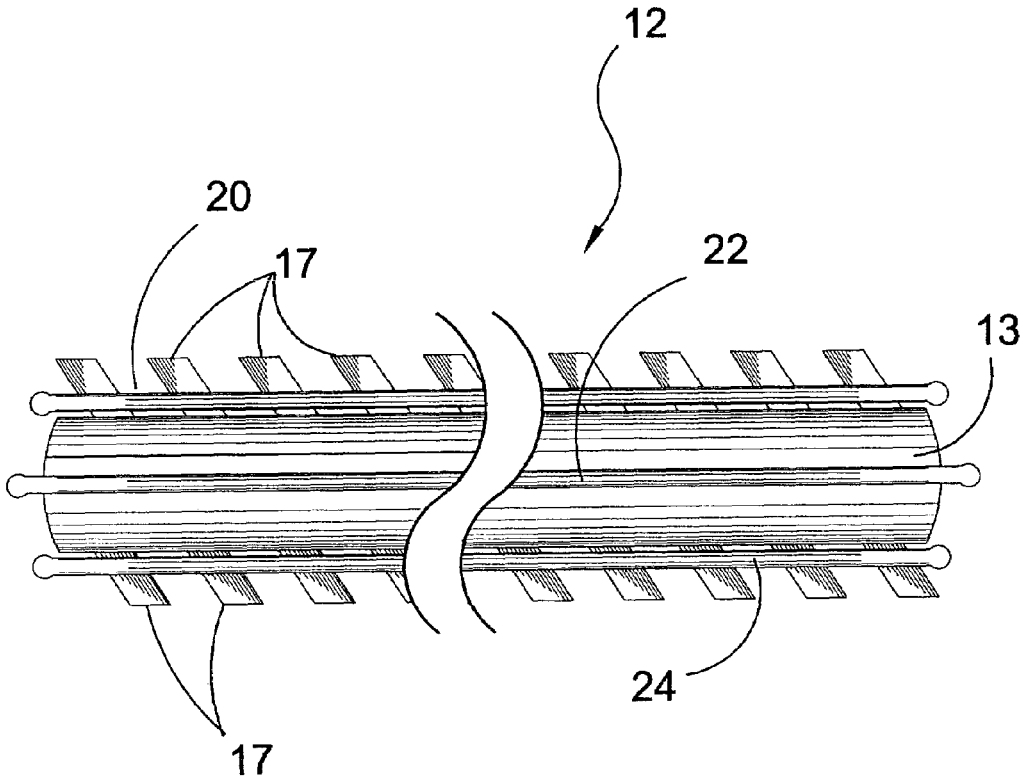
FIG. 5 is a front edge view of the blade of the present invention.

FIG. 5 is a leading edge 13 view of the blade 12 of the present invention. Shown is a leading edge 13 view of the blade 12 showing where cleaning is done between the negative 22, lower positive 24 and upper positive 20 wire grids before air gets to the radiative fins 17.

Figure 6:
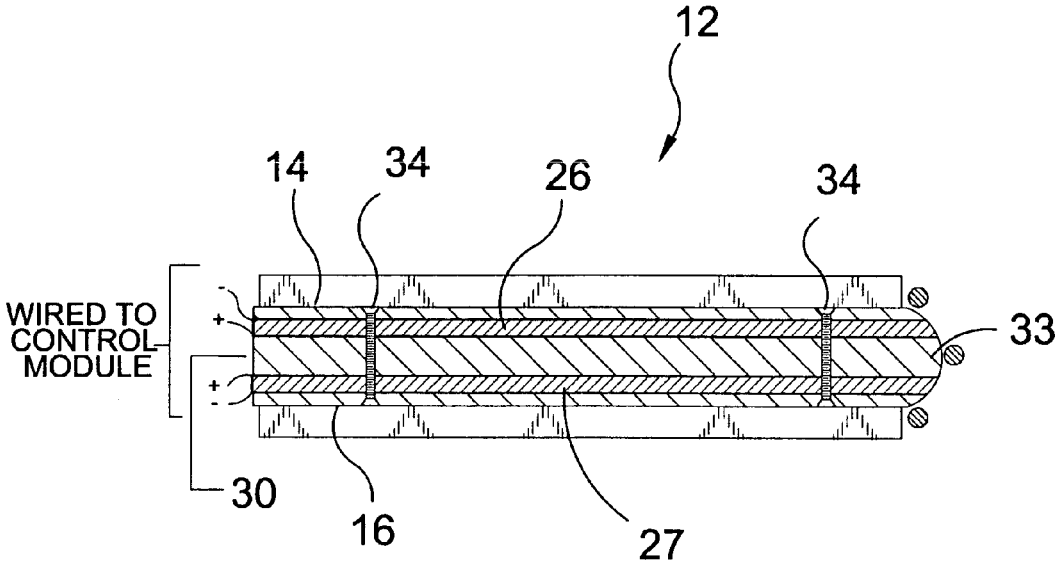
FIG. 6 is a cross sectional view of a blade of the present invention.

FIG. 6 is a cross sectional view of a blade 12 of the present invention. Shown is a cross sectional view of a blade 12 of the present invention depicting the blade 12 of the present invention being composed of an upper blade half 14 and a lower blade half 16 with both layers having a thermoelectric layer 26,27 sandwiching an aluminum substrate to produce a heat sink 30 that may be used for the user's selective heating or cooling of a room. Additionally shown are insulated screws 34 working in cooperation to fasten the two primary layers 14,16 together.

Figure 7:
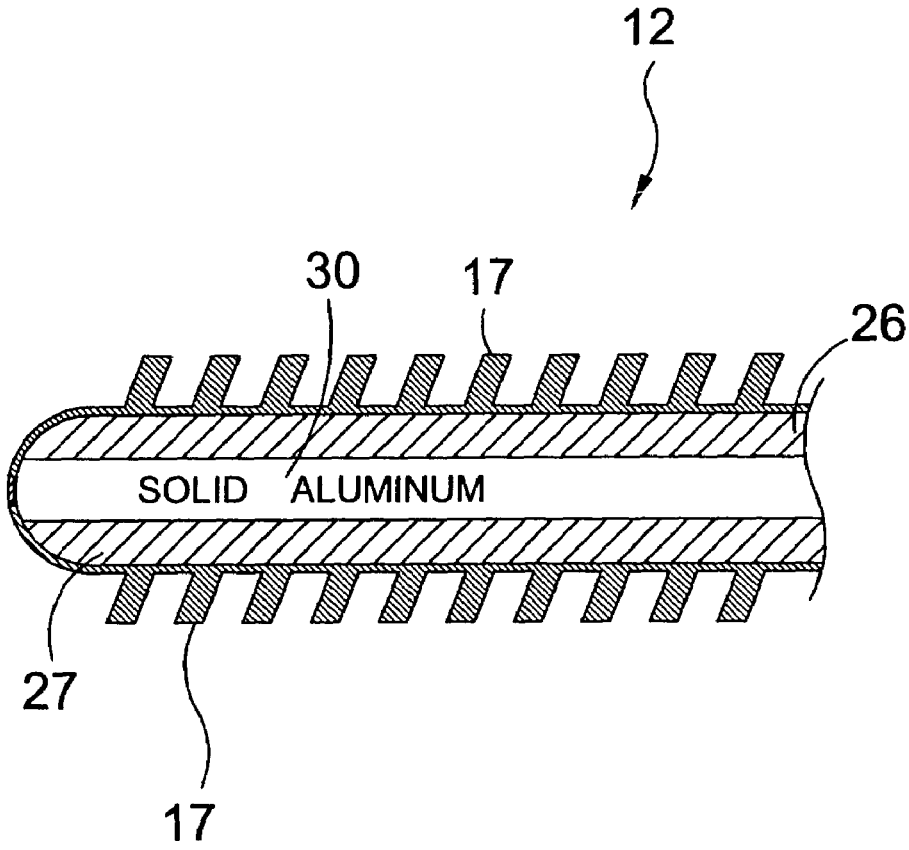
FIG. 7 is a side sectional view of the present invention.

FIG. 7 is a side sectional view of a fan blade 12. Shown is a side view of a fan blade 12 comprising a solid aluminum substrate heat sink 30 surrounded by the upper thermoelectric plate 26 and the lower thermoelectric plate 27. Air flow over the radiative fins 17 will enable heat or cold transfer to the passing air. The blades 12 can be rotated to any angle within a certain degree for either more or less air flow for a selected direction.

Figure 8:
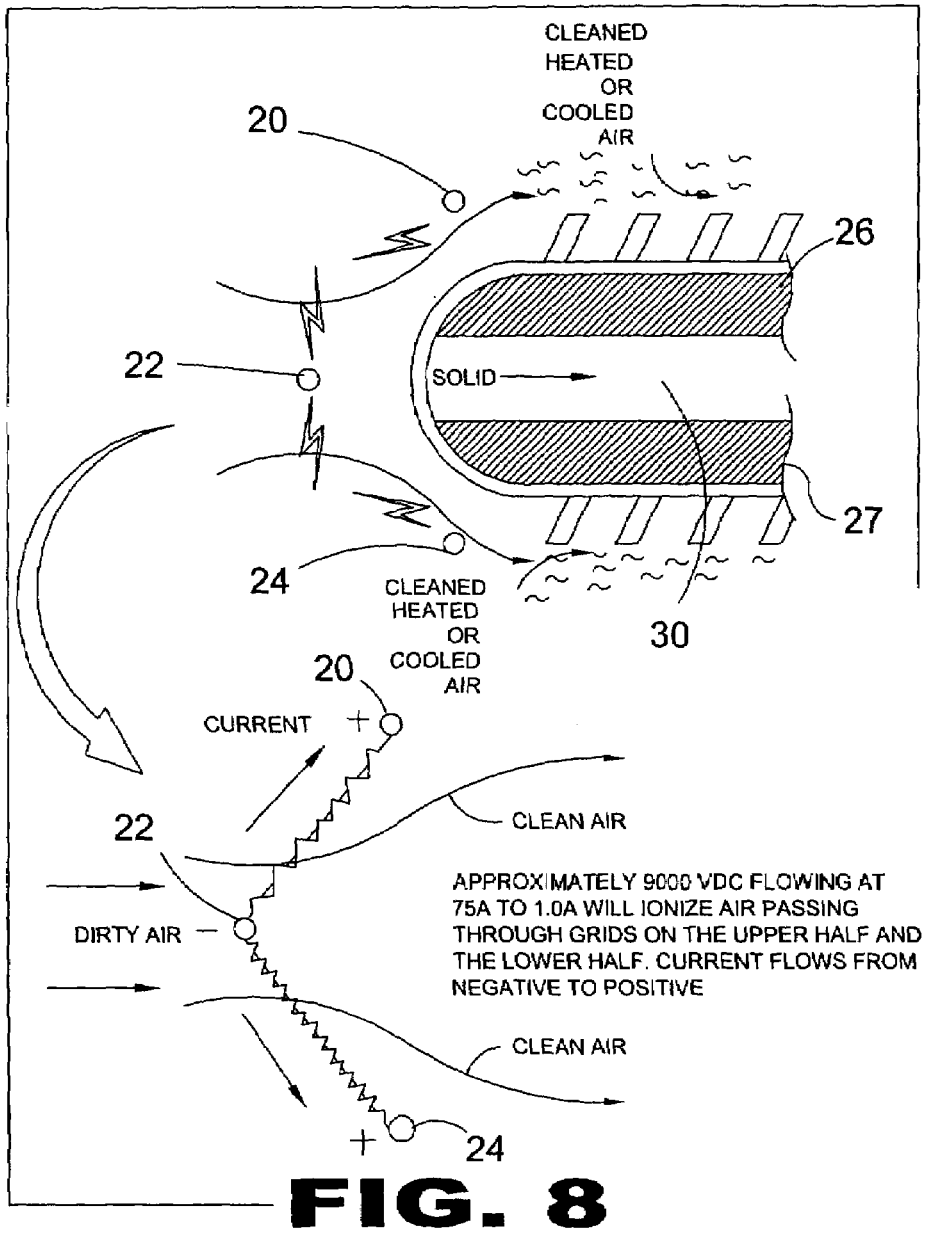
FIG. 8 is a partial side view of the blades of the present invention.

FIG. 8 is a partial side view of a blade 12 of the present invention. A pair of thermoelectric plates 26,27 sandwich a solid aluminum substrate heat sink 30. The thermoelectric plates 26,27 respond to a voltage to result in a temperature decrease or increase in the material. Air passed over the radiative fins 17 communicating with the thermoelectric plates 26,27, by the ordinary movement of the ceiling fan blades 12 is either cooled or heated, depending on the desired temperature modification. The air is cleaned as it passes through the current traveling from the negative wire grid 22 to the upper positive wire grid 20 and the lower positive wire grid 24.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A thermoelectric air-purifying ceiling fan comprising:

a) a main body b) a plurality of fan blades emanating from said main body;

c) ionization means integral with said fan blades to remove particulate matter from passing air;

a thermoelectric means integral with said fan blades for transferring heat to or from said passing air as needed to achieve a selected temperature, wherein said fan blade comprises an upper half, a lower half and a leading edge and said thermoelectric means comprises a thermoelectric plate having a positive side and a negative side disposed on said upper half of said fan blade with a plurality of spaced apart radiative fins extending from the top portion thereof and a thermoelectric plate having a positive side facing the positive side of said upper thermoelectric plate and a negative side disposed on said lower half of said fan blade with a plurality of spaced apart radiative fins extending from the top portion thereof.

2. A thermoelectric air purifying ceiling fan as recited in claim 1, wherein said thermoelectric means further includes an aluminum substrate heat sink disposed between said upper thermoelectric plate and said lower thermoelectric plate thereby forming a thermoelectric sandwich.

3. A thermoelectric air purifying ceiling fan as recited in claim 2, wherein said thermoelectric means further includes a sensor to measure the temperature of the ambient air.

4. A thermoelectric air purifying ceiling fan as recited in claim 3, wherein said thermoelectric means further includes a control module to allow a user to selectively determine the temperature output thereof.

5. A thermoelectric air purifying ceiling fan as recited in claim 4, wherein said thermoelectric plates respond to a voltage to result in a temperature increase or decrease in said thermoelectric plates so that air passing over said plates by the ordinary movement of said fan blades is cooled or heated accordingly depending upon the desired temperature modification programmed into said control module by said user.

6. A thermoelectric air purifying ceiling fan as recited in claim 1, wherein said ionization means is an ionizer grid comprising a negative grid wire extending longitudinally in front of said leading edge of said fan blade, an upper positive grid wire extending longitudinally above and set back from said leading edge of said fan blade and a lower positive grid wire extending longitudinally below and set back from said leading edge of said fan blade thereby effectively forming an air gap which defines the cleaning grid through which air must flow prior to temperature treatment which occurs upon contact with said radiative fins.

7. A thermoelectric air purifying ceiling fan as recited in claim 6, wherein ionization and negative ion generation occur when a charge is applied to said negative grid wire and travels to said positive grid wire thereby purifying air that passes through said ionizer grid by removing dust and other particulate matter from the air.

8. A thermoelectric air purifying ceiling fan as recited in claim 7, wherein the charge applied to said ionizer grid is 9000 volts DC flowing within a range of 0.75–1 amps.

* * * * *